United States Patent [19]

Verboom

[11] 4,437,244

[45] Mar. 20, 1984

[54] METHOD FOR SUCKING UP SOIL OR SLUDGE BY MEANS OF A SUCTION HOPPER DREDGE AS WELL AS A SUCTION DREDGE FOR APPLYING THE METHOD

[75] Inventor: Pieter Verboom, Alblasserdam, Netherlands

[73] Assignee: IHC Holland N.V., Papendrecht, Netherlands

[21] Appl. No.: 418,673

[22] Filed: Sep. 16, 1982

[30] Foreign Application Priority Data

Sep. 17, 1981 [NL] Netherlands ..... 8104293

[51] Int. Cl.[3] ..... E02F 3/88

[52] U.S. Cl. ..... 37/63

[58] Field of Search ..... 37/63, 62, 61, 66, 64, 37/195

[56] References Cited

U.S. PATENT DOCUMENTS

| | | | |
|---|---|---|---|
| 660,956 | 10/1900 | Henderson | 37/66 |
| 1,572,472 | 2/1926 | Doren . | |
| 3,618,236 | 11/1971 | Pipkin | 37/63 |
| 4,146,982 | 4/1979 | Norisugi | 37/64 |

FOREIGN PATENT DOCUMENTS

| | | | |
|---|---|---|---|
| 29469 | 6/1981 | European Pat. Off. . | |
| 33413 | 3/1885 | Fed. Rep. of Germany . | |
| 2055690 | 5/1972 | Fed. Rep. of Germany | 37/63 |
| 918656 | 2/1947 | France . | |
| 1455815 | 10/1966 | France . | |
| 13035 | 11/1924 | Netherlands . | |
| 6501314 | 8/1965 | Netherlands . | |
| 6716115 | 5/1969 | Netherlands . | |
| 7013556 | 3/1972 | Netherlands . | |
| 7114213 | 4/1973 | Netherlands . | |
| 7215543 | 5/1973 | Netherlands . | |
| 150015 | 8/1920 | United Kingdom . | |
| 147832 | 10/1921 | United Kingdom . | |
| 229302 | 2/1969 | U.S.S.R. | 37/62 |
| 238420 | 7/1969 | U.S.S.R. | 37/66 |

OTHER PUBLICATIONS

"The Hopper Dredge", (1954), p. 284.

*Primary Examiner*—Clifford D. Crowder
*Attorney, Agent, or Firm*—Young & Thompson

[57] ABSTRACT

A method for sucking up soil or sludge by means of a suction dredge provided with a suction pipe having a drag head. Through the suction pipe (1) water and soil or sludge are sucked up. The soil or the sludge is loosened in front of the inlet opening of the drag head. Said loosening operation takes place at such a distance from the inlet opening (4) of the drag head (3) that by the loosening operation the gases being liberated remain substantially out of the suction action of the drag head (3). The loosening is performed by injection nozzles (28) and/or cutting blades mounted in a frame (10) swingably mounted about a horizontal axis (9) on the suction tube (1).

3 Claims, 2 Drawing Figures

METHOD FOR SUCKING UP SOIL OR SLUDGE BY MEANS OF A SUCTION HOPPER DREDGE AS WELL AS A SUCTION DREDGE FOR APPLYING THE METHOD

The invention relates to a method for sucking up soil or sludge by means of a suction dredge provided with a suction pipe with drag head by means of which water and soil or sludge are sucked up, in which the soil or the sludge is loosened in front of the inlet opening of the drag head seen in the dragging direction.

Such a method is generally known in various embodiments.

Thus, from the published Dutch Patent Application No. 65 01314 it is known to position right in front of the inlet opening of the drag head a number of injection nozzles directed downwards and through which water is injected into the soil in order to fluidize it and to facilitate in this way the sucking up of it.

From the Dutch Patent No. 13035 it is known to position right in front of the inlet mouth of the drag head a row of plough blades loosening soil and thereby making it transportable for the water stream flowing to the inlet opening of the drag head.

From the British Patent No. 147,832 it is known to provide rotary cutting means right in front of the inlet opening of a drag head.

In dredging, one has to deal with a great variety of material to be dredged by sucking up. Different types of soil, such as peat and many sludge deposits of more or less high density contain gases that are liberated in dredging, in particular when by means of the known cutting means or spraying mouths the initial shear stress is lowered resulting from loosening the soil or the sludge. In the known methods this is encountered as a serious difficulty; see the book "The Hopper Dredge", 1954, p. 284. The gases liberated decrease the pump action and may even annual this completely.

In order to solve that problem it is generally known in pumping gas containing liquids to suck away gases being liberated, through central passage openings of the pump impeller. However, this requires special provisions at the dredging pump making this pump not only more expensive but comprising moreover, a provision which may not be provided quickly in existing suction dredges.

Now, the object of the invention is to provide a method as well as a suction dredge by means of which the problem of the gases liberated is solved in a simple way.

According to the invention this object is obtained in that said operation of loosening takes place at such a distance from the inlet opening of the drag head that the gases liberated by loosening remain substantially out of the suction action of the drag head.

Thus, the invention is based on the principle that the soil or sludge is torn loose at a considerable distance from the inlet mouth of the drag head such that the gases that are liberated have the opportunity to escape upwards thereby to remain out of the sphere of influence of the drag head both during the liberation and when escaping upwards.

In a suction dredge this may be realized in a simple way by providing cutting means or injection nozzles on a frame extending from the suction pipe downwards by a sufficiently large spacing from the inlet opening of the drag head, which spacing will amount some meters.

Such a frame may be constructed in a simple way and be fixed to each existing suction pipe. Moreover, in using injection nozzles it may be useful to make them adjustable concerning their angle of inclination with respect to the vertical so that they may be oriented more or less far to the front.

Preferably the injection nozzles are constituted by at least a row of openings in a pipe which extends transversely to the dragging direction. It is conceivable to apply several openings, for example openings directed downwards and openings directed frontwards. It is also conceivable to use cutting means provided with injection nozzles so that a combined function may be obtained.

The loosening operation of the soil or the sludge for liberating the gases should be carried out with some care in order to prevent a large mud cloud from being built up in the area to be processed, because then, the percentage of solid particles in the water stream sucked by the drag head is too low for loading the suction hopper dredge in an efficient way. However, the extent of loosening may be controlled empirically readily by particular in using injection nozzles the pressure in which is controllable within broad limits.

Preferably the frame is fixed pivotably to the suction pipe and provided with means by which the frame may be moved between a position swung away and in which the frame engages the suction pipe and a downward operating position. The loosening means may be put in operation easily as soon as one wants it.

Now, the invention will be elucidated with reference to the drawings.

Figure 1:
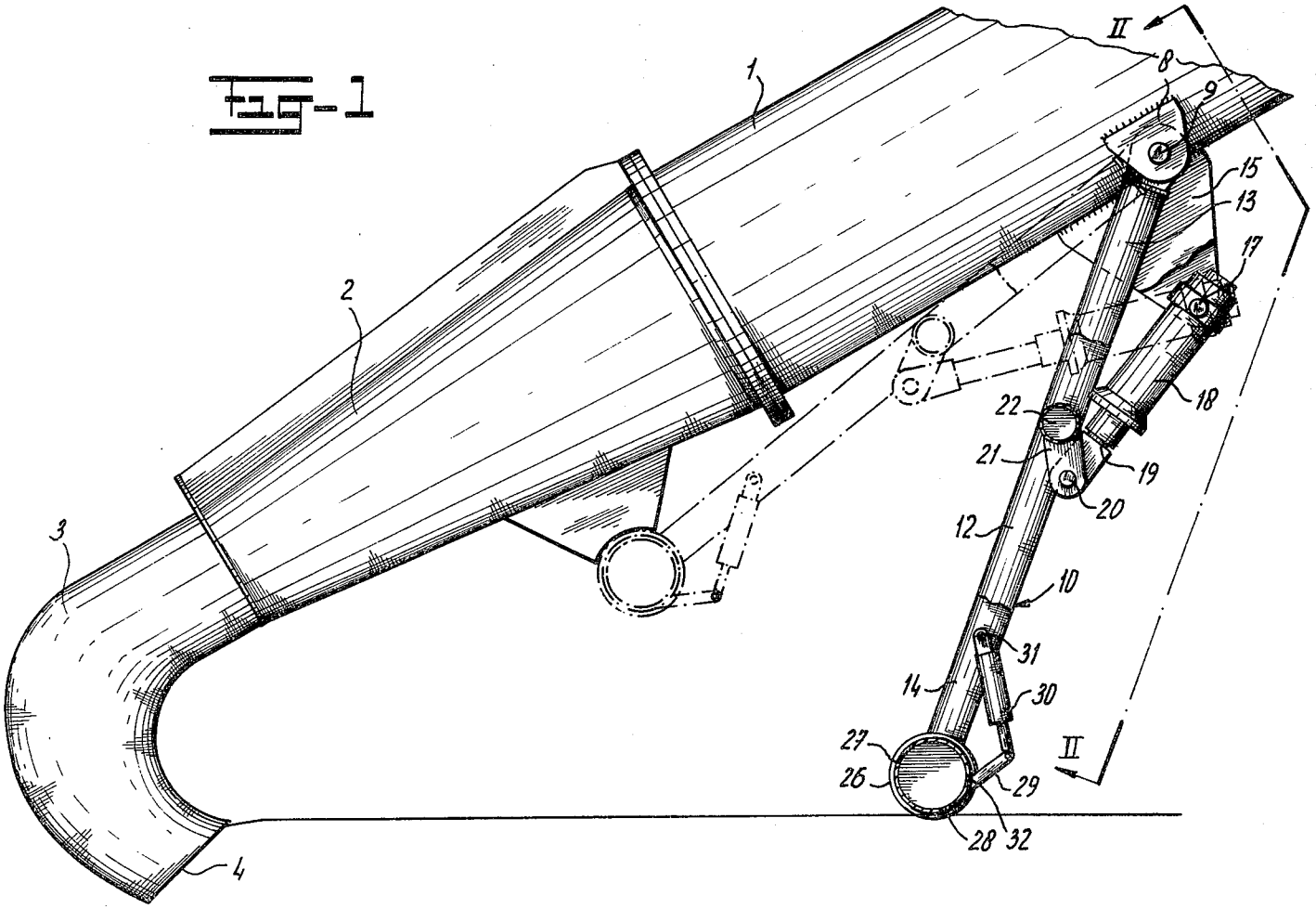
FIG. 1 shows in side view the lower end of the suction tube of a suction hopper dredge according to the invention.
Figure 2:
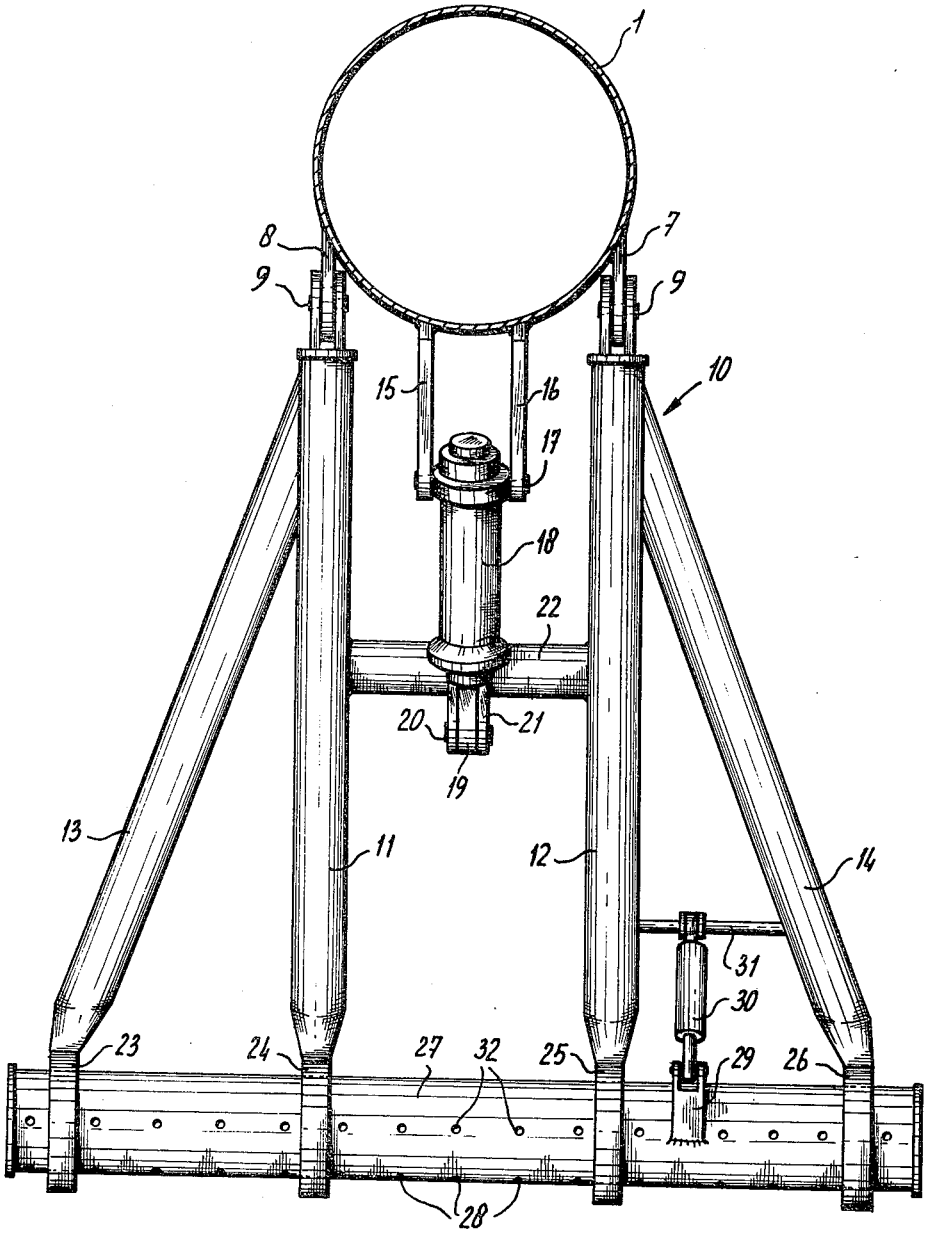
FIG. 2 is a section along the line II—II in FIG. 1.

In the drawings the lower end is shown of a suction pipe 1 to which through an intermediate piece 2 is fixed a drag head 3 having inlet opening 4.

At the lower side of the suction pipe lugs 7 and 8 are welded to which a frame 10 is fixed pivotably by means of pivot pins 9, said frame is built up from the parallel pipes 11 and 12 and the pipes 13 and 14 including downwardly outwardly.

Approximately in the center between the lugs 7 and 8 at the lower end of the pipe two triangular supports 15 and 16 are welded by which at the location of the pivot axis 17 a hydraulic cylinder 18 is mounted the piston rod 19 of which is coupled pivotably at 20 to the arms 21 fixed to a transverse pipe 22 located between the pipes 11 and 12.

As shown in FIG. 1, by means of said cylinder 18 the frame 10 may be displaced between the operating position indicated by solid lines and the inactive upwardly swing position indicated by dot and dash lines, in which the frame engages the lower side of the suction pipe.

The lower ends of the pipes 11, 12, 13 and 14 support through bearings 23, 24, 25 and 26 a pipe 27 provided with a series of outlet openings 28. On the pipe an arm 29 is provided coupled to the hydraulic cylinder 30 supported by a transverse bar 31 of the frame. By means of the cylinder 30 the pipe may be rotated so that the position of the outlet openings 28 may be varied.

It is conceivable to provide the pipe also with outlet openings 32 directed frontwards.

Instead of a pipe fixed adjustably it is also possible to fix the pipe 27 stationarily on the frame. If one gives the cylinder 18 sufficient space of stroke then, by displacing the frame more or less frontwards one can vary the spraying angle simultaneously with a stationarily fixed pipe having injection nozzles. Moreover, one has the possibility to bring the pipe with injection nozzles farther from the inlet opening 4 of the drag head. This is realisable in a simple way by positioning the supports 15 farther to the front and upwards to the suction pipe and giving the cylinder 18 a sufficient long length of stroke. Then, besides the shown operating position the frame with the pipe 27 may assume also an operating position or positions oriented much farther to the front.

I claim:

1. In a suction dredge having a suction pipe and drag head and provided with loosening means for loosening soil or sludge positioned in front of the inlet opening of the drag head seen in the dragging direction; the improvement in which said loosening means are disposed at such a distance from the inlet opening of the drag head that the gases liberated by the loosening operation remain substantially out of the suction action of the drag head, said loosening means being secured to a frame which extends downwardly from the suction pipe a substantial distance from the inlet opening of the suction pipe, said loosening means comprising a plurality of injection nozzles, and means acting between said frame and said pipe for swinging said frame upwardly to a raised inoperative position and downwardly to a lowered operative position about a horizontal pivot by which said frame is secured to said pipe.

2. A suction hopper as claimed in claim 1, and means for varying the angle of inclination of the injection nozzles.

3. A suction dredge as claimed in claim 1, said injection nozzles comprising a series of openings in a pipe extending transversely of the dragging direction.

* * * * *